US007220190B2

(12) United States Patent
Hirano

(10) Patent No.: US 7,220,190 B2
(45) Date of Patent: May 22, 2007

(54) GOLF CLUB HEAD

(75) Inventor: Tomoya Hirano, Kobe (JP)

(73) Assignee: SRI Sports Limited, Kobe-shi (JP)

( * ) Notice: Subject to any disclaimer, the term of this patent is extended or adjusted under 35 U.S.C. 154(b) by 279 days.

(21) Appl. No.: 10/968,172

(22) Filed: Oct. 20, 2004

(65) Prior Publication Data

US 2005/0101407 A1 May 12, 2005

(30) Foreign Application Priority Data

Nov. 11, 2003 (JP) ..... 2003-381772

(51) Int. Cl.
*A63B 53/04* (2006.01)

(52) U.S. Cl. ..... 473/342; 473/330; 473/345; 473/349

(58) Field of Classification Search ..... 473/324–350, 473/290, 291
See application file for complete search history.

(56) References Cited

U.S. PATENT DOCUMENTS 6,428,426 B1 * 8/2002 Helmstetter et al. ..... 473/330
6,508,722 B1 * 1/2003 McCabe et al. ..... 473/330
6,623,377 B2 * 9/2003 Evans et al. ..... 473/342
7,014,570 B2 * 3/2006 Evans et al. ..... 473/329
7,018,303 B2 * 3/2006 Yamamoto ..... 473/329

FOREIGN PATENT DOCUMENTS

| | | | |
|---|---|---|---|
| JP | 9-192273 | A | 7/1997 |
| JP | 9-299519 | A | 11/1997 |
| JP | 2001-29523 | A | 2/2001 |
| WO | WO-99/36132 | A1 | 7/1999 |

* cited by examiner

*Primary Examiner*—Nini F. Legesse
(74) *Attorney, Agent, or Firm*—Birch, Stewart, Kolasch & Birch, LLP

(57) ABSTRACT

A golf club head having a face portion that hits a ball, which includes: a center thick portion; a portion of a varying thickness in annular form; and a peripheral thin portion provided around the portion of a varying thickness, where the peripheral thin portion of which the thickness is the smaller than that of the center thick portion. The peripheral thin portion includes a first thin portion and a second thin portion. The first thin portion is provided in at least one portion of a sole portion, a toe portion and a heel portion of the peripheral thin portion.

8 Claims, 12 Drawing Sheets

E1 cross-section

GOLF CLUB HEAD

This Nonprovisional application claims priority under 35 U.S.C. § 119(a) on Patent Application No(s). 2003-381772 filed in Japan on Nov. 11, 2003, the entire contents of which are hereby incorporated by reference.

BACKGROUND OF THE INVENTION

1. Field of the Invention

The present invention relates to a golf club head that is helpful for increasing a region of a high coefficient of restitution so as to increase carry for a golfer of average skill.

2. Description of the Background Art

Importance is placed on the function of increasing the carry of a hit ball of a golf club head, in particular, a wood type golf club head. Therefore, a variety of methods for increasing the coefficient of restitution of the head has been proposed by respective golf club manufacturers. According to one of such methods for increasing the coefficient of restitution of the head, a structure is known where a thin portion in annular form is provided on the back side of the face portion so that the face bends sufficiently at the time when a ball is hit as described in the Published patent application No. H09-192273, or No. H09-299519. In addition, it is known that a thin portion where the thickness has been reduced is provided in an arbitrary region of the face portion, as described in the Japanese Translation of PCT International Patent Publication No. WO99/36132, or Published patent application No. 2001-29523.

According to conventional methods, although attention is paid to increasing the value of the coefficient of restitution, an idea to extend the "region" with a high coefficient of restitution is not provided. On the other hand, it is unreasonable to expect a golfer of average skill to always hit a ball at the same point on the face surface. Accordingly, in order to effectively increase carry for a golfer of average skill, it becomes important to form a region of a high coefficient of restitution in a wider range of the face portion, in addition to increase in the numeral value of the coefficient of restitution. However, this hasn't been sufficiently attempted yet in conventional heads.

SUMMARY OF THE INVENTION

It is therefore, an object of the invention is to provide a golf club head, which has a increased region having a high coefficient of restitution.

An aspect of the present invention is to provide a golf club head having a face portion that hits a ball complies:

a center thick portion that forms the center region having the greatest thickness, which includes the sweet spot having a substantially uniform thickness;

a portion of a varying thickness in annular form, which is formed around the above described center thick portion, and where the thickness gradually decreases toward the periphery of the face portion; and a peripheral thin portion provided around the above described portion of a varying thickness, where the thickness is smaller than that of the above described center thick portion, the above described peripheral thin portion of which the thickness is the smaller than that of the center thick portion, the peripheral thin portion includes a first thin portion of which the thickness is substantially constant, and a second thin portion of which the thickness is greater than that of the first thin portion and substantially constant, and in addition, the above described first thin portion is provided in at least one portion of a sole portion, a toe portion and a heel portion of the above described peripheral thin portion.

DESCRIPTION OF THE PREFERRED EMBODIMENTS

In the following, the preferred embodiments of the present invention are described in reference to the drawings.

Figure 1:
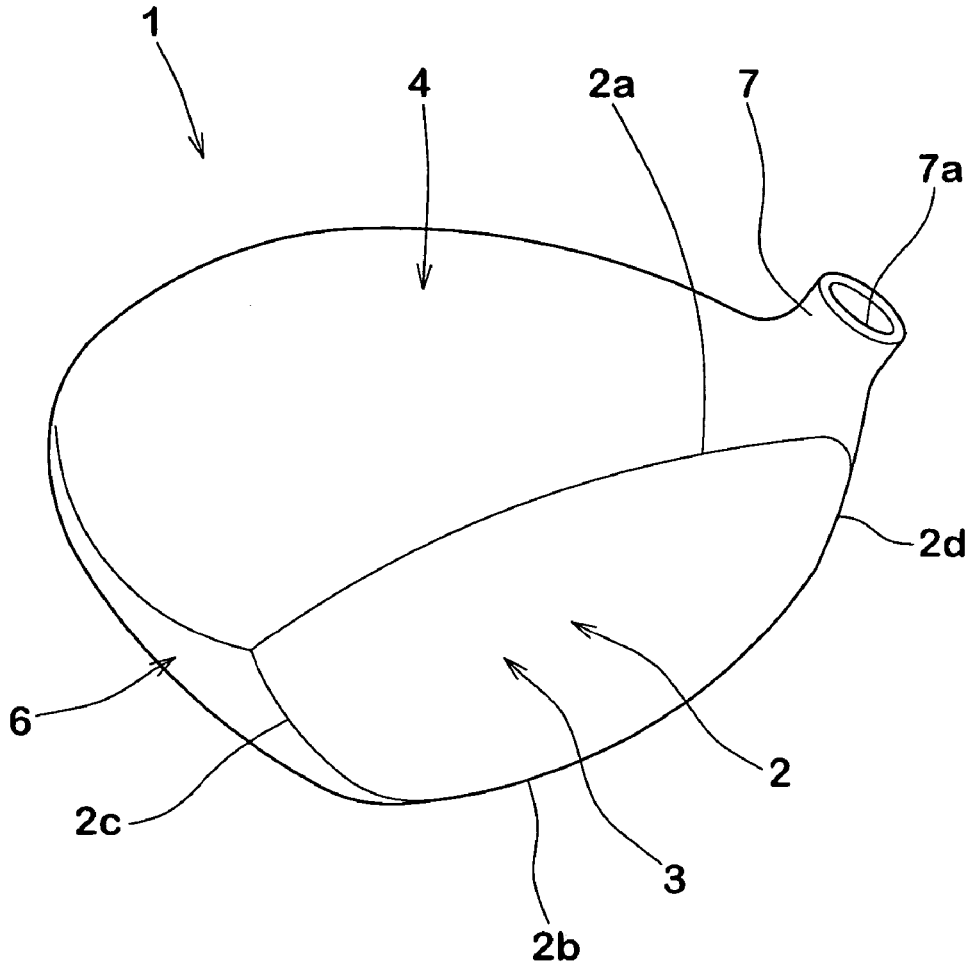
FIG. 1 is a perspective view showing the entirety of a head according to an embodiment of the present invention.
Figure 2:
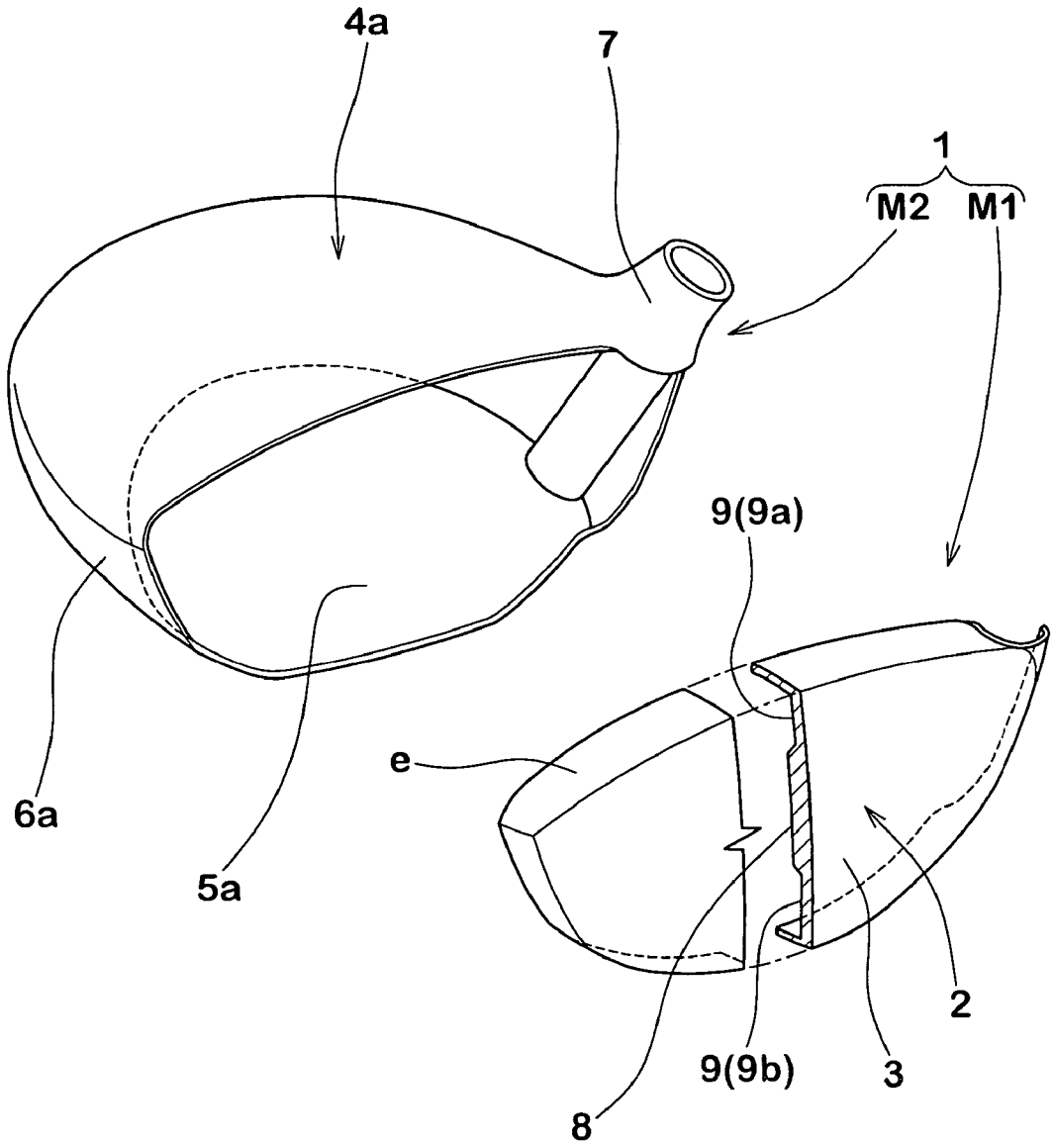
FIG. 2 is an exploded perspective view showing the head.
Figure 3:
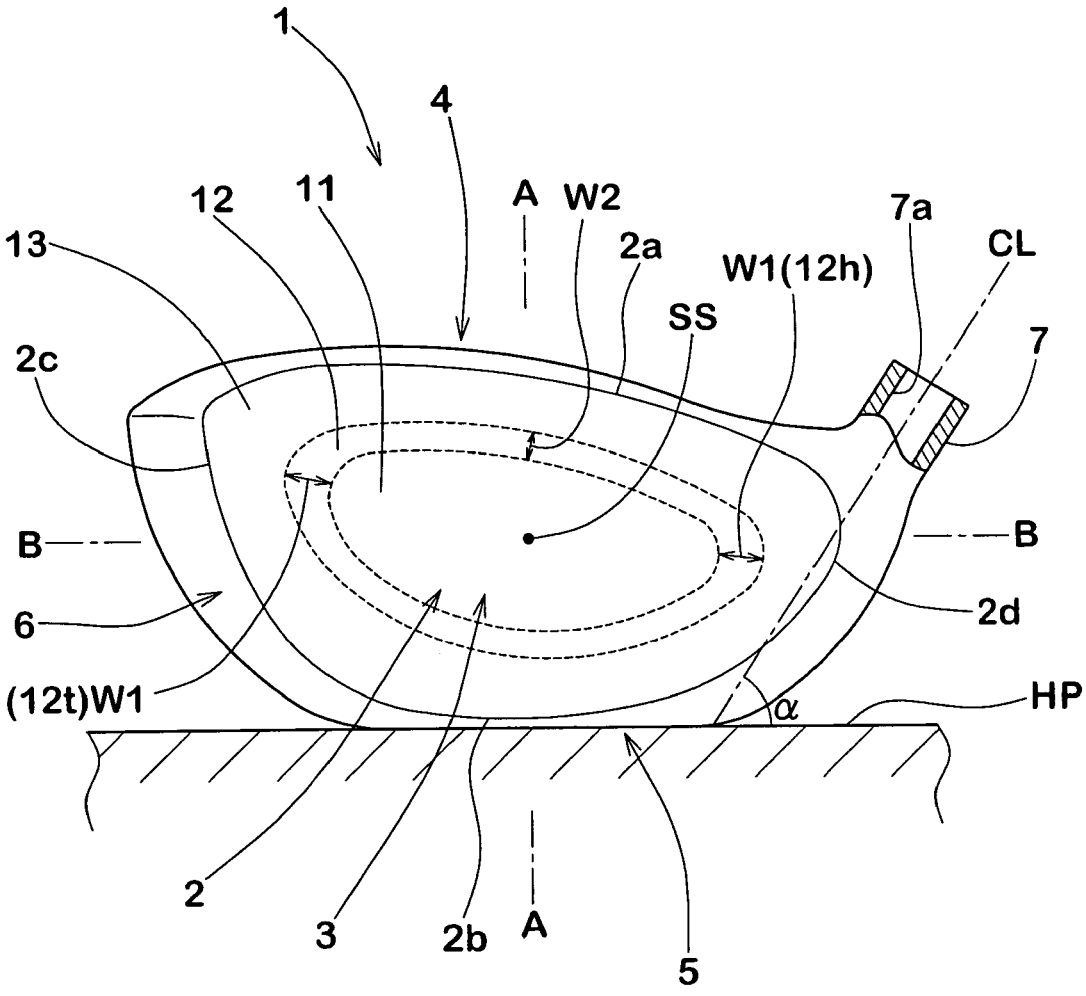
FIG. 3 is a front view showing the head viewed from the face surface side.
Figure 4A:
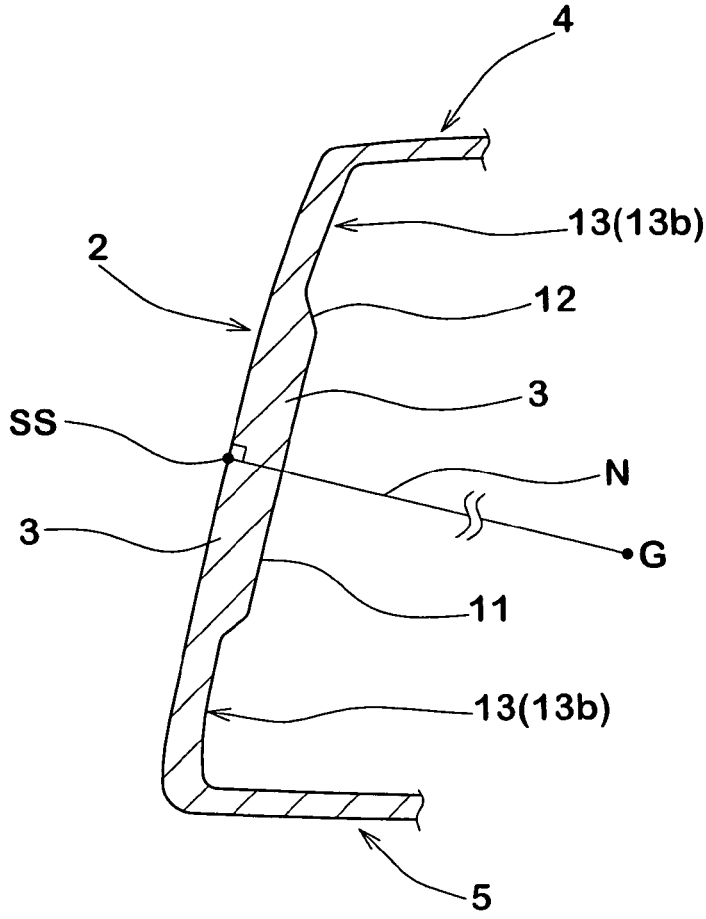
FIG. 4(A) is a fragmentary end view along A—A of FIG. 3.
Figure 4B:
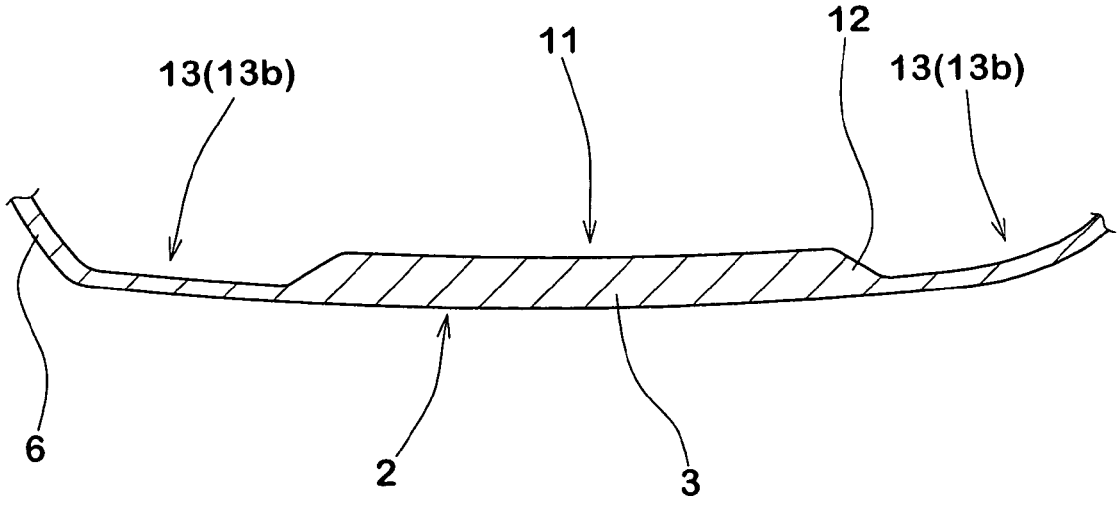
FIG. 4(B) is a fragmentary end view along B—B of FIG. 3.

FIG. 1 is a perspective view of a golf club head (hereinafter may simply be referred to as "head") 1 according to the present embodiment; FIG. 2 is an exploded perspective view before the assembly of the golf club head; FIG. 3 is a front view showing the standard condition of the head viewed from the face surface side; and FIGS. 4(A) and 4(B) are cross-sectional views showing the respective portions along lines A—A and B—B of FIG. 3. Here, the standard condition of the head is the condition where head 1 is placed on a horizontal plane HP at a lie angle a and a loft angle b (real loft angle), which are prescribed for the head.

In the figures, the head 1 of the present embodiment is illustrated as a wood type head, in which a hollow is provided and which includes: a face portion 3 having a face surface 2, which is a surface that hits a ball; a crown portion 4 which continues to the upper periphery 2*a* of the above described face surface 2 so as to form the upper surface of the head; a sole portion 5 which continues to the lower periphery 2*b* of the face surface 2 so as to form the bottom surface of the head; a side portion 6 which connects the crown portion 4 to the sole portion 5 and which extends from the edge 2*c* on the toe side of the face surface 2 through the back face to the edge 2*d* on the heel side of the face surface 2; and a hosel 7 placed in the vicinity of the portion where the face portion 3, the crown portion 4 and the side portion 6 cross on the heel side, into which one end of a shaft, not shown, is inserted. Here, the hosel 7 is in a cylindrical form having a shaft insertion hole 7*a*, where the lie angle a is set on the basis of the center line CL of the axis of the hosel.

The head 1 of the present embodiment is illustrated as having a two-piece structure that is formed by welding a face member M1 in approximately bowl form to a head body member M2 as shown in FIG. 2. The face member M1 is formed of the face portion 2 and an edge portion e which continues to the periphery of the face portion and extends toward the rear of the head. The head body member M2 is formed of a crown main portion 4*a*, a sole main portion 5*a*, a side main portion 6*a* and a hosel portion 7, which are integrated with each other.

The face member M1 can, for example, be forged, and the head body M2 can be cast, respectively. Here, they are not limited to this example, but rather, they may be manufactured of other materials according to other methods. In addition, the hollow inside the head may be left as hollow, or in some cases, a forming resin, a weight member or the like may be placed in the hollow. In such a case, the filling material or the like may be placed in such a manner so as not to make contact with the back side of the face portion 3, preventing damage in the coefficient of restitution of the face portion.

In addition, the head 1 can be formed of a variety of types of metal materials, such as, for example, an aluminum alloy, titanium, a titanium alloy, stainless steel, maraging steel. In the case where the head is formed of two or more parts, different materials can be used for the respective parts. In addition, though in some cases, a fiber enforced resin is used for a portion or the entirety of the head 1, a titanium alloy is preferable. A titanium alloy of a great strength having a low elasticity, particularly Ti-15V-6Cr-4Al, Ti-4.5Al-3V-2Mo-2Fe (SP700), Ti-6Al-4V, Ti-15V-3Cr-3Al-3Sn and the like are preferable for the face member M1. sus 630, maraging steel, which are non-titanium materials, and the like, in addition to, for example, Ti-6Al-4v are preferable for the head body M2.

Figure 5:
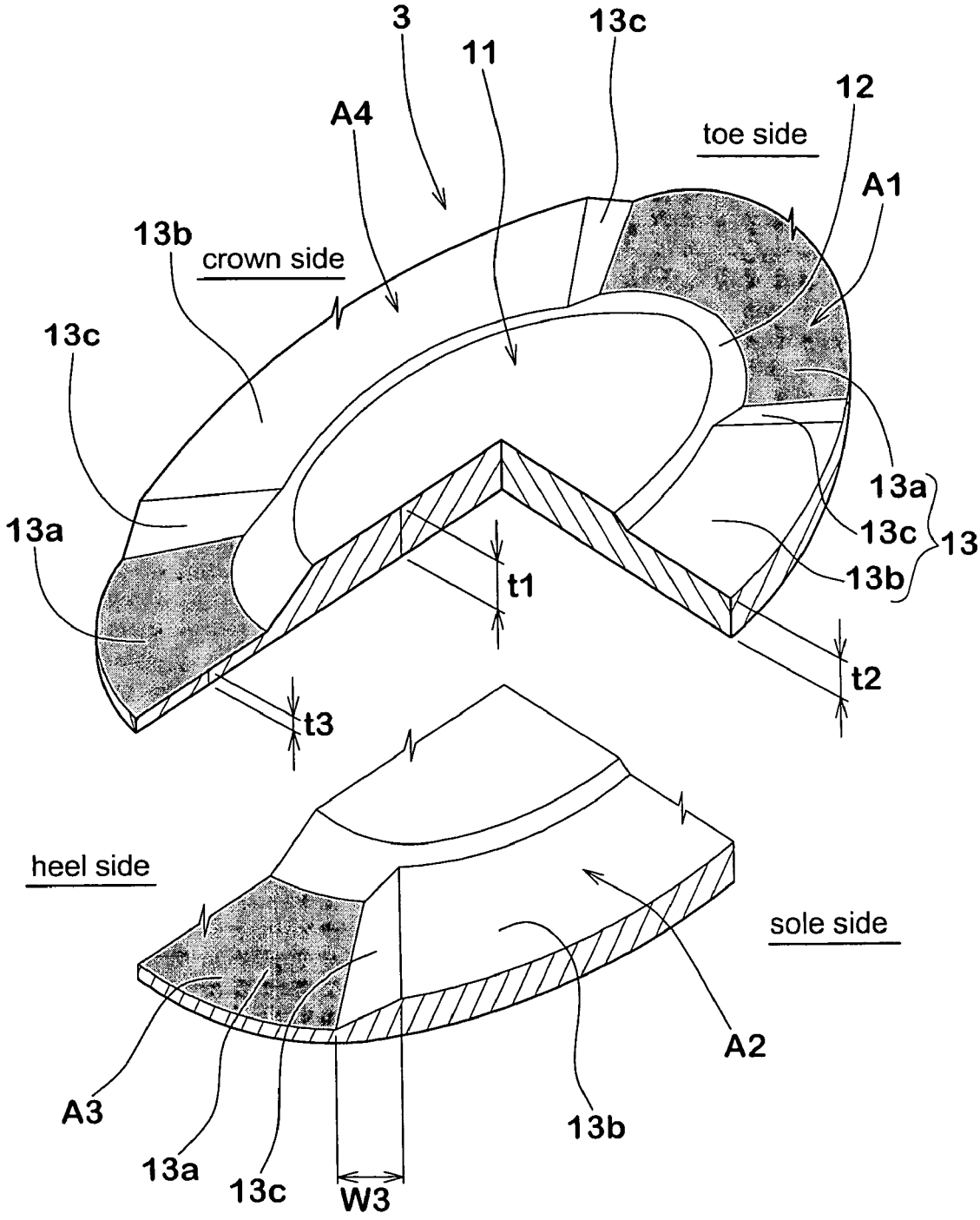
FIG. 5 is a partially perspective view showing the face portion cut out from the head.

The face portion 3 of the head 1 according to the present invention is formed of: a center thick portion 11; a portion of a varying thickness 12 in annular form formed around this center thick portion 11 of which the thickness gradually decreases toward the periphery of the face portion 3; and a peripheral thin portion 13 provided around this portion of a varying thickness 12, of which the thickness is smaller than that of the above described center thick portion 11, as shown in FIGS. 3 to 5 (drawing of the face portion 3 as seen from the back surface).

The center thick portion 11 is formed to have a substantially uniform thickness t1, which is the thickest portion in the face portion 3, and forms the center region of the face portion 3 that includes the sweet spot SS. The sweet spot SS is a point where the normal line N that is drawn toward the face surface 2 from the center of gravity G of the head crosses this face surface 2 as shown in FIG. 4(A).

A preferred thickness t1 of the center thick portion 11 can be appropriately set, taking the type of material that is utilized into account. Therefore, though this thickness is not particularly limited, it is preferable for it to be not less than 2.6 mm, it is more preferable for it to be not less than 2.7 mm, and it is still more preferable for it to be not less than 2.8 mm. The center thick portion 11 is expected to hit a ball frequently, and therefore, in the case where the above described thickness t1 is less than 2.6 mm, there is a risk that the durability of the face portion 3 will be reduced, and the face portion may be deformed or damaged due to the repeated impacts with balls.

Contrarily, in the case where the thickness t1 of the center thick portion 11 is too great, though the durability of the face portion 3 increases, the bend of the face portion 3 at the time when hitting a ball becomes too small, reducing the coefficient of restitution and the carry tends to be smaller. Considering the above point, it is preferable for the above described thickness t1 to be not greater than 3.2 mm, it is more preferable for it to be not greater than 3.0 mm, and it is still more preferable for it to be not greater than 2.9 mm in the combination of any of the above described lower limit values. Here, the thickness t1 of the face portion 3 is gained by measuring the portion of the face portion excluding the face line, which is a trench (not shown), in the case where such a face line is provided in the face surface 2.

In addition, the center thick portion 11 is formed to have a substantially constant thickness. As a result of this, a thick portion can be formed so as to range widely in the center region that includes the sweet spot SS, thus helping to enhance the strength of the face portion 3. Being the substantially constant thickness indicates that the thickness needs not be strictly constant, but rather, there may be a difference in the thickness due to the manufacturing process or other such factors. According to a representative standard, at least the condition where the difference in the thickness is approximately +/−0.2 mm can be considered to be a condition where the thickness is substantially constant.

In addition, the shape of the center region formed of the center thick portion 11 is not particularly limited, as long as the center region is a constant thick region that includes the sweet spot SS. According to a preferable mode, as show in FIGS. 3 and 5, a region in elliptic form is desirable, which is long sidewise and which is approximately similar to the peripheries 2*a* to 2*d* on the face surface 2, with the sweet spot SS at the center. As a result of this, the center thick portion 11 can be effectively provided as a point that hits a ball to a golfer of average skill whose hit point tends to shift in the toe and heel directions of the face surface 2.

In addition, though the area of the center region is not particularly limited, in the case where it is too small, the strength of the face portion 3 is easily reduced, while in the case where it is too large, the coefficient of restitution is easily reduced. Considering the above point, it is preferable for the area of the center region formed of the center thick portion 11 to be not less than 20% of the surface area (surface area gained by filling the face line, if any) of the face surface 2, and it is more preferable for it to be not less than 35%. It is preferable for the upper limit to be, for example, not greater than 60%, and it is more preferable for it to be not greater than 50% in combination with any of the above described lower limit values.

Figure 6A:
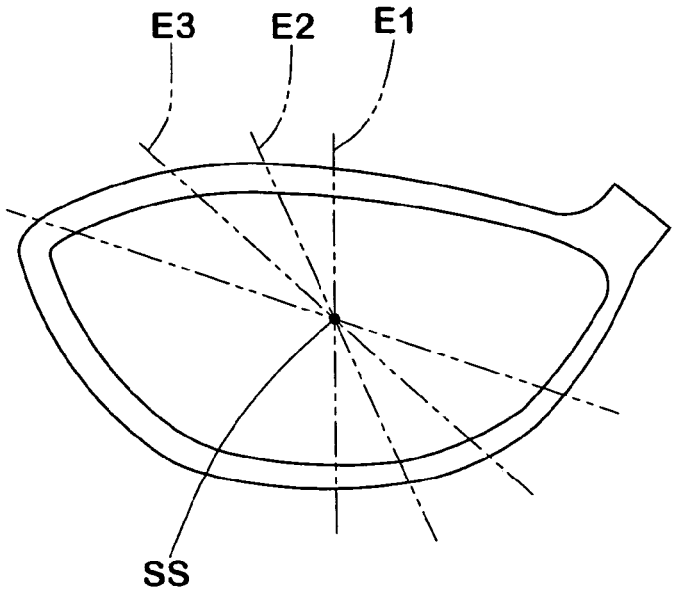
FIG. 6(A) is a front view of the head illustrating the periphery of the face surface.
Figure 6B:
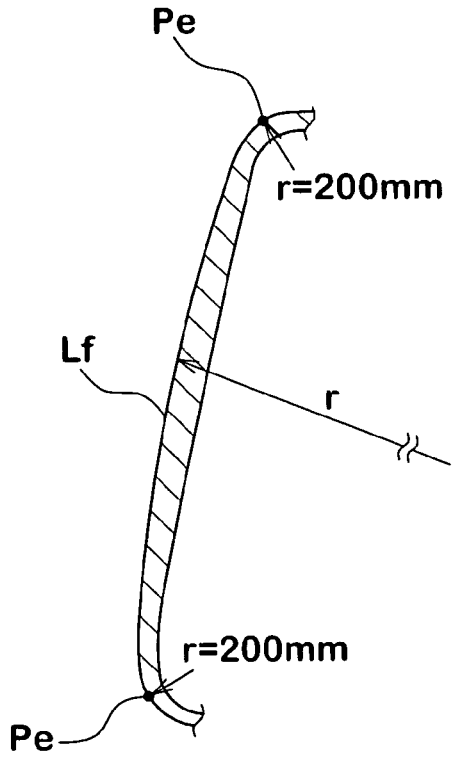
FIG. 6(B) is a cross-sectional view thereof.

The periphery 2*a* to 2*b* of the face surface 2 at the time when the area of the face surface 2 or the like is confirmed is defined as the edge in the case where the periphery forms a clear edge. However, in the case where there are no clear edges, first, as shown in FIG. 6(A), the face portion is cut by a number planes E1, E2, . . . that include the line connecting the center of gravity of the head G and the sweet spot SS, so that contour line Lf on the outer surface of the face is found, as shown in FIG. 6(B), on each of the cross-sections. Then, the curvature radius r of the contour line Lf on the outer surface of the face is measured starting from the center of the face surface toward the outside, and thereby, the position Pe where the curvature radius r becomes 200 mm for the first time is set as the above described periphery.

The above described portion of a varying thickness 12 is formed around the center thick portion 11 and continues to the peripheral thin portion 13 with the thickness decreasing smoothly and gradually toward the periphery of the face portion 3. The portion of a varying thickness 12 as described above prevents a rigidity step from being created in the face portion 3, thus preventing stress concentration at the time when hitting a ball and increasing the durability of the face portion 3, on the basis of a step due to the difference in the thickness between the center thick portion 11 and the peripheral thin portion 13.

In addition, the portion of a varying thickness 12 is helpful in making uniform the bend of the face portion 3, even in the case where a ball is hit by a point outside of the sweet spot. A conventional head is not provided with such a portion of a varying thickness 12. Therefore, in the case where a ball is hit by a point on the toe side or on the heel side of the sweet spot SS, the bend of the face portion becomes extremely small, reducing carry a great deal. In addition, the face portion 3 cannot be bent uniformly, and therefore, sounds at a variety of frequencies are emitted at the time when hitting a ball, and sound reverberation becomes a short sound of hitting a ball and the feeling of hitting a ball is not desirable. In contrast to this, the bend of the face portion is made uniform in the head 1 according to the present embodiment even in the case where a ball is mis-hit in the toe or heel direction, and thereby, a great loss in carry can be prevented, and the sound of reverberation can be lengthened, enhancing the sensation of hitting a ball.

The portion of a varying thickness 12 according to the present embodiment does not have a constant width, but rather, has the maximum width portions 12*t* and 12*h* where the width becomes a maximum on the toe side and on the heel side, as shown in FIG. 3. It is desirable for the width W1 of these maximum width portions 12*t* and 12*h* to be not less than 5 mm and not greater than 15 mm. In addition, the portion of a varying thickness is formed to have a width W2 of 3 mm to 10 mm on the crown side and on the sole side, according to the present embodiment. In addition, it is preferable for the ratio of a varying thickness to be 15% to 70% on the toe side and on the heel side, while it is preferable for the ratio of a varying thickness to be 22% to 70% on the crown side and on the sole side with regard to the portion of a varying thickness 12. Here, the ratio of a varying thickness is the ratio of the difference between the maximum thickness and the minimum thickness of the portion of a varying thickness 12 to the width of the portion of a varying thickness 12. As described above, the maximum width portions 12*t* and 12*h* having great widths are provided on the toe side and on the heel side, and thereby, a wide range of hit points by golfers ranging from beginner to expert can be dealt with by using the head according to the present embodiment.

The above described peripheral thin portion 13 continues to the portion of a varying thickness 12, and forms a region that extends to the outer periphery of the face portion in the present example. This peripheral thin portion 13 includes a first thin portion 13*a* having a substantially constant thickness t3 which is the minimum and a second thin portion 13*b* having a substantially constant thickness t2 which is greater than that of the first thin portion 13*a*. That is to say, the head 1 of the present invention adopts a so-called thin face periphery structure, and in addition, further difference in the thickness is provided in this peripheral thin portion. Thus, the first thin portion 13*a* of which the thickness t3 is the smallest is provided in at least one portion of the toe portion A1, the sole portion A2 and the heel portion A3 of the peripheral thin portion 13. This embodiment shows a mode wherein the first thin portion 13*a* is provided in the toe portion A1 and in the heel side portion A3 of the peripheral thin portion 13, and the crown side portion A4 and the sole portion A3 are formed of the second thin portion 13*b*.

Figure 7:
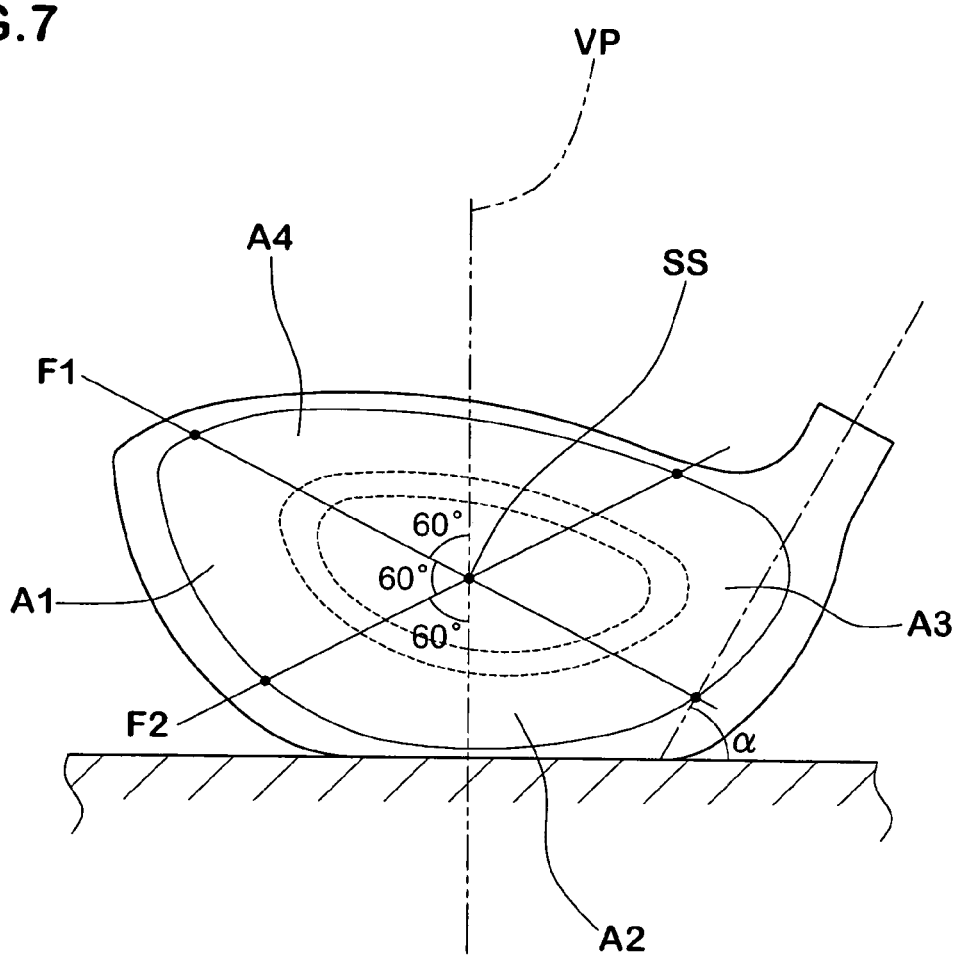
FIG. 7 is a front view of the head.

In addition, as for the toe side portion A1, the heel side portion A3, the crown side portion A4 and the sole side portion A2 in the peripheral thin portion 13, as shown in FIG. 7, a vertical plane VP that passes through the sweet spot SS and the center of gravity of the head G in the standard condition of the head 1, a first inclined plane F1 that inclines at 60 degrees relative to this vertical plane VP, and a second inclined surface F2 that further inclines at 60 degrees relative to this first inclined surface F1 are respectively set by assuming. These three planes cross each other at the above described normal line N which passes through the sweet spot SS and the center of gravity of the head G. Thus, each region on the toe side, on the sole side, on the heel side or on the crown side divided by the above described first and second inclined surfaces F1 and F2 is set as the toe portion A1, the sole portion A2, the heel portion A3 and the crown portion A4, according to the assumption.

The first thin portion 13*a* provides the region of a high coefficient of restitution. Therefore, it becomes possible to further expand the region of which the coefficient of restitution has been increased, in comparison with a conventional head. It is not preferable to form the crown portion A4 in the first thin portion 13*a*. This is because the crown side portion A4 continues to the crown portion 4 formed to have a small thickness, and the durability of the head is easily reduced in the case where the first thin portion 13*a* is formed in the crown side portion A4.

It has been found that there are many cases where the point that hits a ball shifts in the toe or heel direction from the sweet spot SS, based on an observation of the points that hit a ball of a great number of golfers of average skill. However, in the case where a ball is mis-hit in the toe or heel direction, carry is reduced greatly in comparison with the case where a ball is mis-hit by a point shifted to the crown side or to the sole side. It is considered that this is caused by the gear effects of the head. The gear effects indicate a phenomenon where the head makes a rotation motion around the vertical axis of the center of gravity G, in the case where a ball is hit by a point shifted toward the toe side or toward the heel side of the head, while a force in the opposite direction of this works on the ball so as to create a sidespin. The sidespin created by the gear effects works as a force that bends the trajectory of the ball in the right or left direction, causing a great loss of carry.

Figure 8:
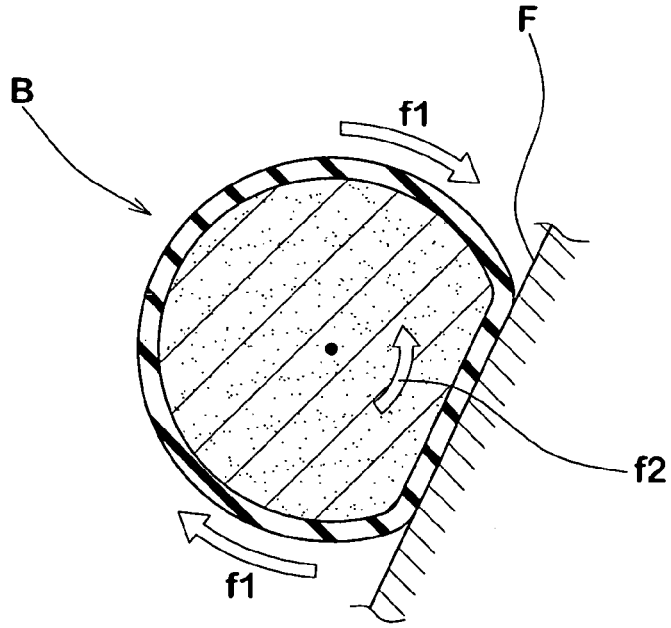
FIG. 8 is a schematic cross-sectional view illustrating the recoil effect at the instant when the face surface hits a ball.

On the other hand, as shown in FIG. 8, at the instant when a ball B makes contact with the face surface F, an internal friction f2 works on the inside of the ball B so as to twist the ball in the direction opposite to the force f1 that is generated to create backspin in the ball. Such a phenomenon has become apparent as a result of computer analysis in recent years, and in general, is referred to as "recoil effect." This internal friction f2 prevents backspin, and therefore, the more significantly the recoil effect occurs in the head, the smaller the amount of backspin in the ball. In addition, the longer the contact time between the ball and the face surface is, the more significantly the recoil effect occurs in the head.

That is to say, the more the head bends at the time when hitting a ball, exhibiting the more function of the restitution, the greater the above described effects become. The same phenomenon can be achieved with respect to the sidespin due to the gear effects.

The first thin portion 13*a* is provided in the toe side portion A1 and in the heel side portion A2 of the head 1, according to the present embodiment, and therefore, a significant recoil effect occurs in the case where the ball is mis-hit by a point on the toe side or on the heel side where the above described thickness is the smallest. As a result of this, the working effects of the sidespin accompanying the gear effect become smaller in the ball. As a result of this, the loss in carry can be reduced.

As described above, the first thin portion 13*a* is created in the toe side portion A1 and in the heel side portion A3 of the peripheral thin portion 13, and thereby, the region of a high restitution can be widely set in accordance with the hit point of golfers of average skill, thus increasing carry more effectively and providing a head having an excellent sound of hitting a ball.

In addition, in the head 1 according to the present embodiment, a thin portion of a varying thickness 13*c* where the thickness gradually decreases starting from the second thin portion 13*b* toward the first thin portion 13*a* is provided between the first thin portion 13*a* and the second thin portion 13*b* in the peripheral thin portion 13. Accordingly, the occurrence of a rigidity step accompanying a difference in the thickness can be prevented in the peripheral thin portion 13, further increasing the durability of the face portion 3. In order to enhance such an effect, it is preferable for the outer width W3 of the thin portion of a varying thickness 13*c* to be not less than 3 mm and not greater than 10 mm, and furthermore, it is more preferable for the width to be not less than 5 mm and not greater than 7 mm.

Though the thickness t3 of the first thin portion 13*a* is not particularly limited, there is a risk where the strength of this portion is lowered, causing a crack or the like at the time when hitting a ball in the case where the thickness is too small, and contrarily, there is a tendency where an expansion in the region of a high restitution becomes hard to gain in the case where the thickness is too great. It is preferable for the thickness t3 of the first thin portion 13*a* to be not less than 1.70 mm, and it is more preferable for the thickness to be not less than 1.80 mm, while it is preferable for the upper limit of the thickness to be not greater than 2.30 mm in combination with any of the above described lower limits, it is more preferable for the thickness to be not greater than 2.20 mm, and it is still more preferable for the thickness to be not greater than 2.00 mm.

In addition, though the thickness t2 of the second thin portion 13*b* is not particularly limited, there is a risk where the strength of the peripheral thin portion 13 may be reduced in the case where the thickness is too small, and contrarily, an increase in the effects of the function of restitution tends not to be gained from the thin periphery structure in the case where the thickness is too great. In view of the above described points, it is preferable for the thickness t2 of the second thin portion 13*b* to be not less than 2.00 mm, and it is more preferable for the thickness to be not less than 2.10 mm, while it is preferable for the upper limit of the thickness to be not greater than 2.50 mm in combination with any of the above described lower limit values, it is more preferable for the thickness to be not greater than 2.40 mm, and it is still more preferable for the thickness to be not greater than 2.30 mm.

A preferable interrelationship between the thickness t1 of the center thick portion and the thicknesses t2 and t3 of the peripheral thin portion 13 is as follows, taking the total balance of the face portion 3 into consideration.

First, it is preferable for the ratio (t3/t1) of the thickness t3 of the first thin portion 13*a* to the thickness t1 of the center thick portion 11 to be not less than 0.55, it is more preferable for the ratio to be not less than 0.60, and it is still more preferable for the ratio to be not less than 0.65, while it is preferable for the upper limit to be not greater than 0.85 in combination with any of the above described lower limit values, it is more preferable for the ratio to be not greater than 0.80, and it is still more preferable for the ratio to be not greater than 0.75.

In addition, it is preferable for the ratio (t2/t1) of the thickness t2 of the second thin portion 13*b* to the thickness t1 of the center thick portion 11 to be not less than 0.65, it is more preferable for the ratio to be not less than 0.70, and it is still more preferable for the ratio to be not less than 0.72, while it is preferable for the upper limit to be not greater than 0.90 in combination with any of the above described lower limit values, it is more preferable for the ratio to be not greater than 0.85, and it is still more preferable for the ratio to be not greater than 0.84.

Furthermore, it is preferable for the ratio (t3/t2) of the thickness t3 of the first thin portion 13*a* to the thickness t2 of the second thin portion 13*b* to be not less than 0.68, and it is more preferable for the ratio to be not less than 0.75, while it is preferable for the upper limit to be not greater than 0.95 in combination with any of the above described lower limit values, it is more preferable for the ratio to be not greater than 0.85, and it is still more preferable for the ratio to be not greater than 0.84.

In addition, in the case where the respective areas of the center thick portion 11, the first thin portion 13*a* and the second thin portion 13*b*, which are respectively projected on the face surface 2, are assumed to be S1, S2 and S3, it is preferable for the area ratio (S2/S1) to be not less than 0.2, and it is more preferable for the area ratio to be not less than 0.3, while it is preferable for the upper limit to be not greater than 0.65, and it is more preferable for the area ratio to be not greater than 0.55. In addition, it is preferable for the area ratio (S3/S1) to be not less than 0.1, and it is more preferable for the area ratio to be not less than 0.13, while it is preferable for the upper limit to be not greater than 0.3, and it is more preferable for the area ratio to be not greater than 0.25. In addition, when the area of the face surface is assumed to be S, it is desirable for the ratio (S1/S) to be not less than 0.15 and not greater than 0.50.

Figure 9:
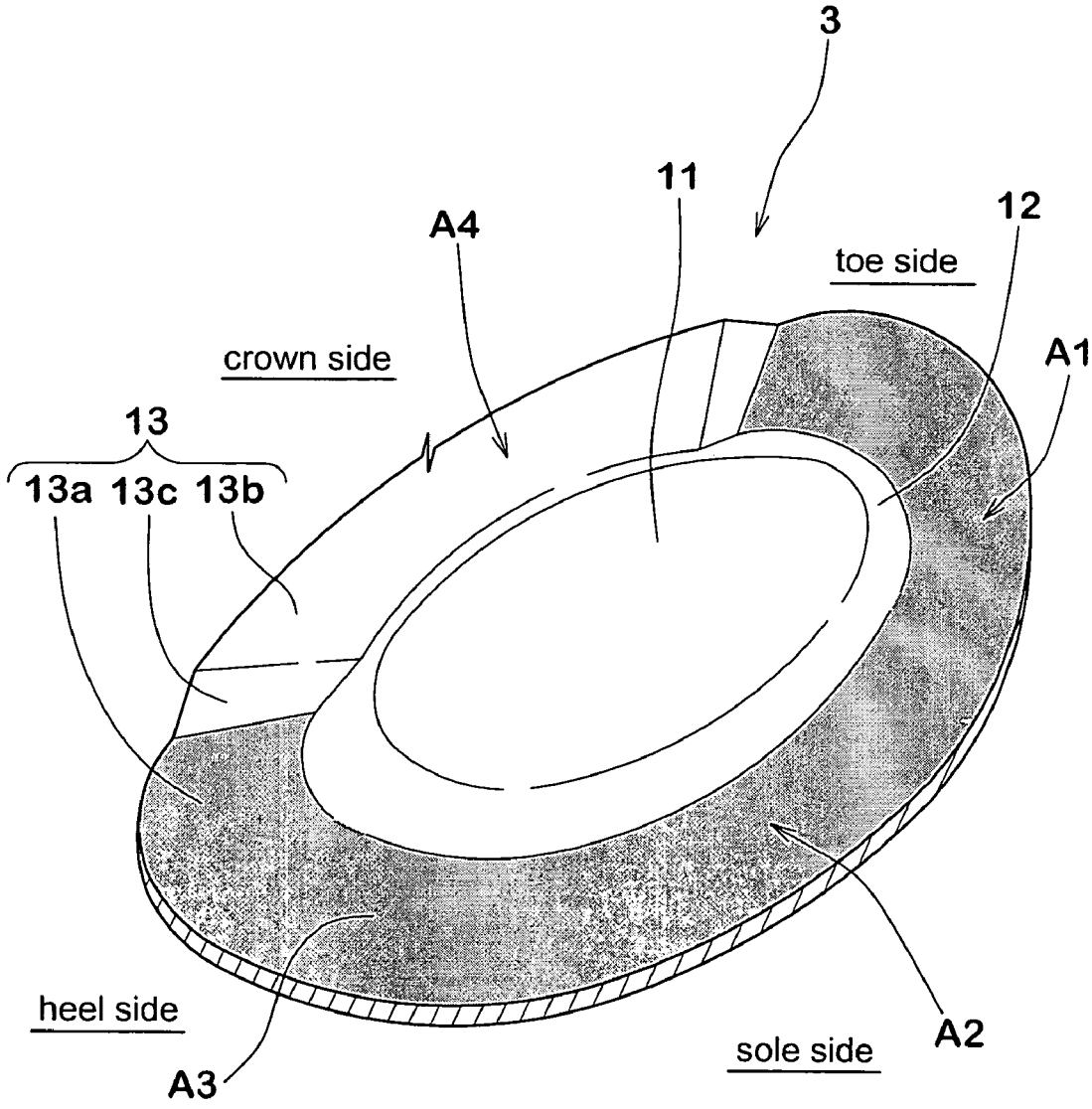
FIG. 9 is a partially perspective view showing the face portion cut out from a head according to another embodiment of the present invention.
Figure 10:
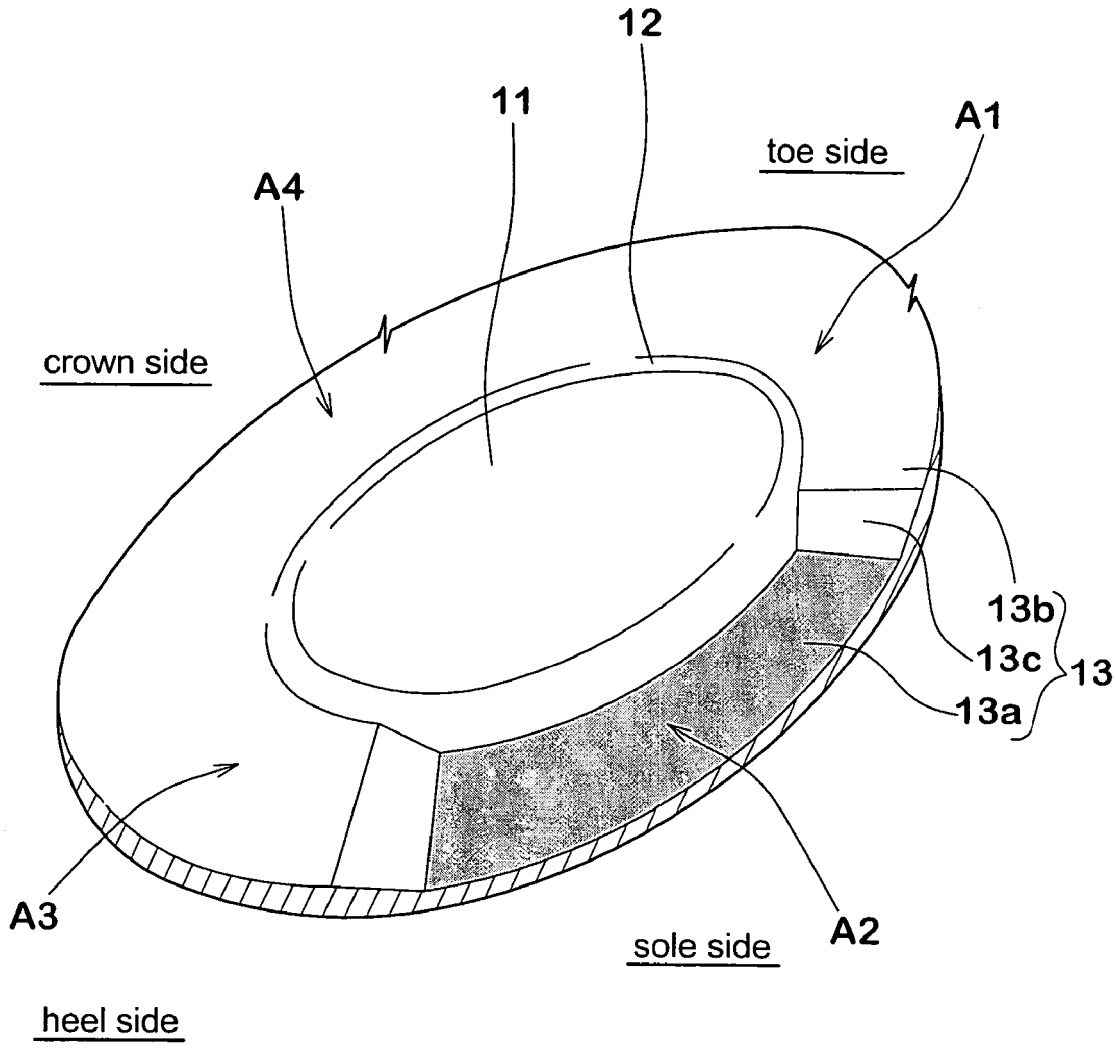
FIG. 10 is a partially perspective view showing the face portion cut out from a head according to still another embodiment of the present invention.

FIGS. 9 and 10 show other embodiments of the present invention. The embodiment of FIG. 9 is illustrated as a mode wherein the first thin portion 13*a* is provided in the toe side portion A1, in the sole side portion A2 and in the heel side portion A3 in a continuous manner in the peripheral thin portion 13. The second thin portion 13*b* is provided in the crown side portion A4 of the above described peripheral thin portion 13.

In addition, the embodiment of FIG. 10 is illustrated as a mode wherein the first thin portion 13*a* is provided in the sole side portion A2 of the above described peripheral thin portion 13, and the second thin portion 13*b* is provided in the toe side portion A1, in the crown side portion A4 and in the heel side portion A3 in a continuous manner. The head 1 of such an embodiment allows the region of a high restitution to be greatly expanded to the sole side.

EXAMPLES

The head of a driver having a head volume of 360 $cm^3$ and a real loft angle of 10 degrees was prototyped on the basis of the specifications of Table 1. Each head was manufactured by welding a face member made of a forged product in bowl form to a head body made of a casted product, both of which are shown in FIG. 2. Here, Ti-15V-6Cr-4Al (DAT55G) was utilized as the material for the face member, and Ti-6Al-4V was utilized as the material for the head body, respectively. Then, a shaft was attached to each prototype head so as to manufacture a wood type golf club having a full length of 45 inches. In addition, for the purpose of comparison, golf clubs (Comparative Examples 1 and 2) where the peripheral thin portion 1 is formed to have a thickness of one type and a golf club (Comparative Example 3) having no portion of a varying thickness were also manufactured. The gist of the tests is as follows.

<Total Area of Region of High Restitution>

Figure 11:
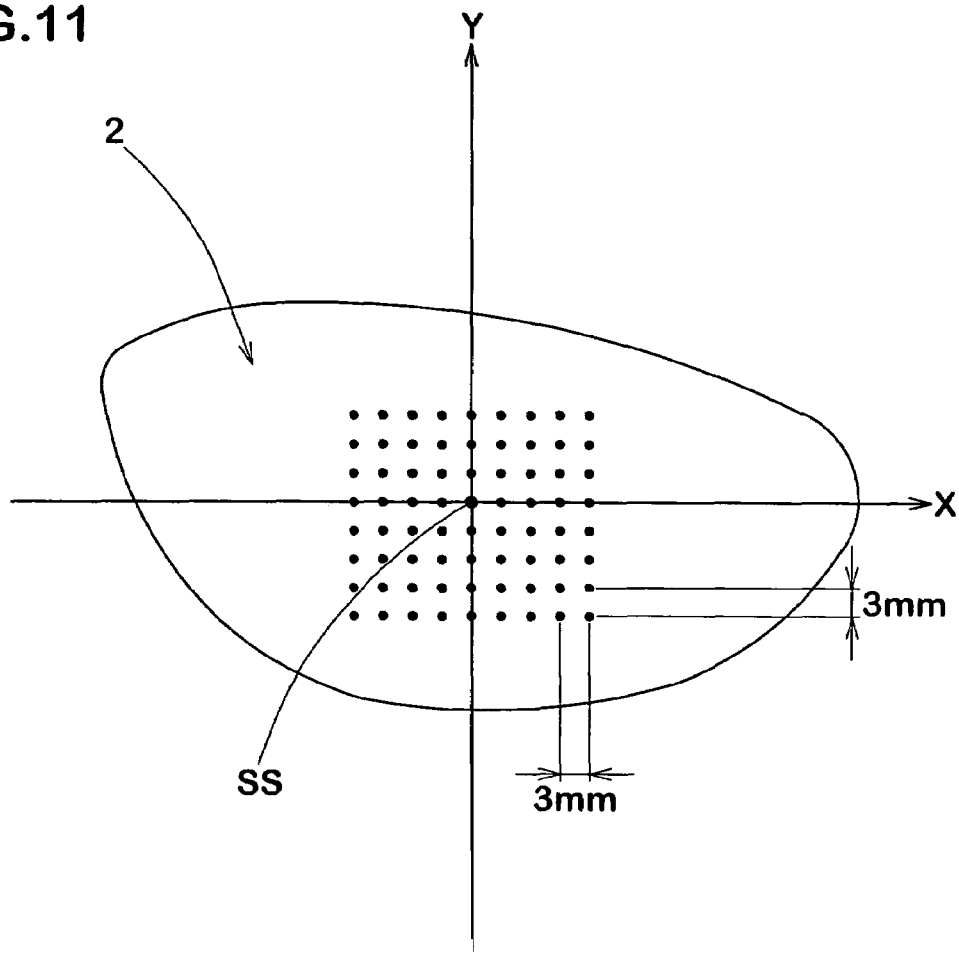
FIG. 11 is a schematic front view of the face surface illustrating a method for measuring the coefficient of restitution of the face portion.
Figure 12:
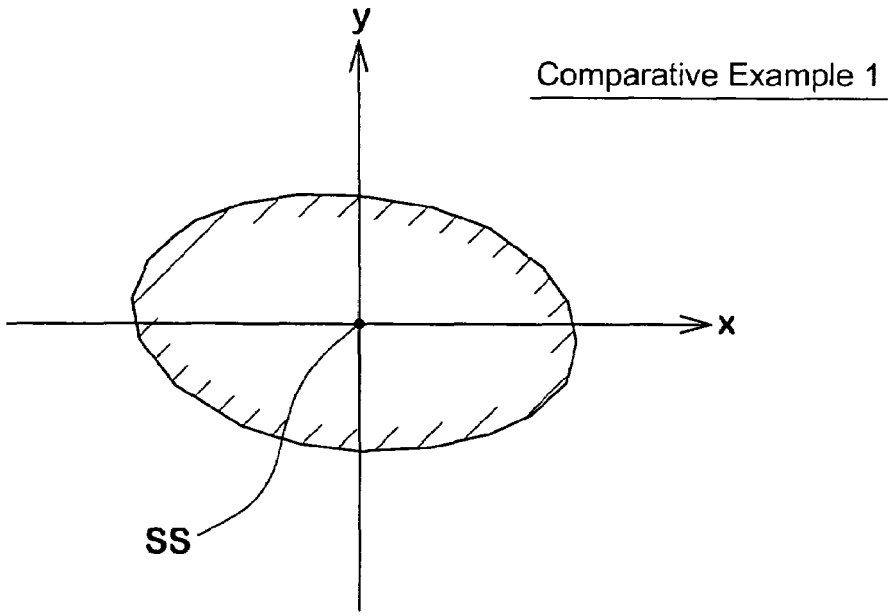
FIG. 12 is a graph showing the results of the measurement indicating the sweet area of the comparative Example.
Figure 13:
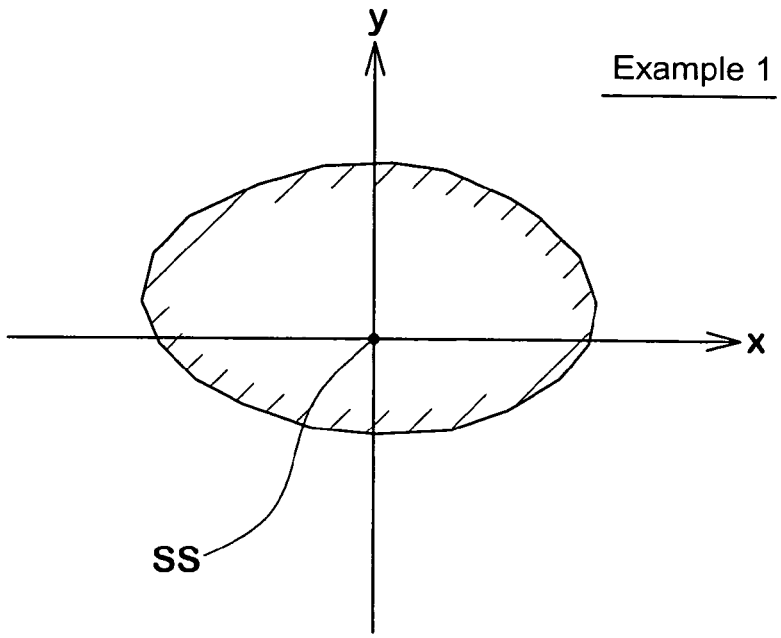
FIG. 13 is a graph showing the results of the measurement indicating the sweet area of Example 1.
Figure 14:
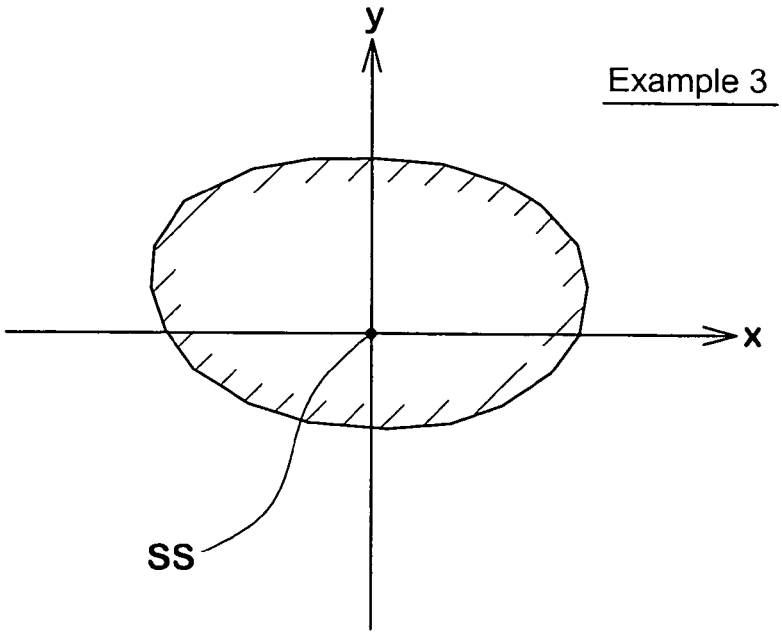
FIG. 14 is a graph showing the results of the measurement indicating the sweet area of Example 2.
Figure 15:
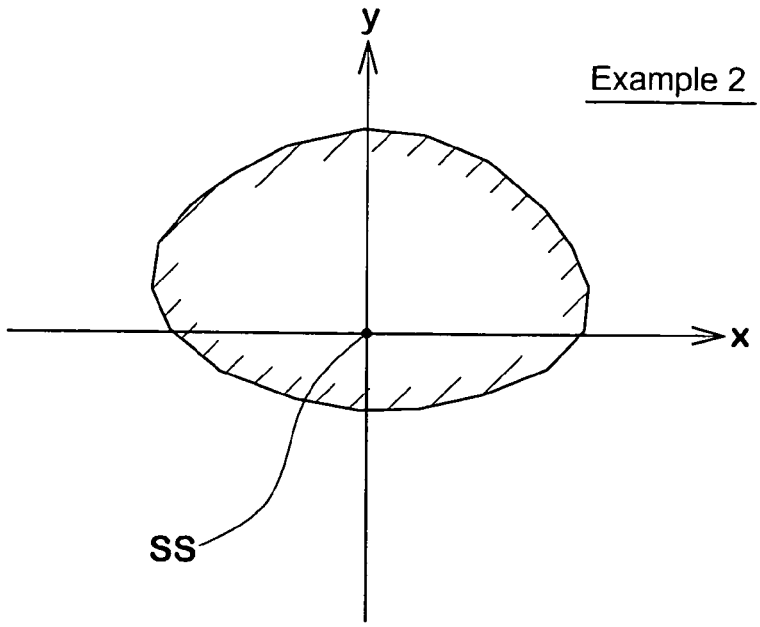
FIG. 15 is a graph showing the results of the measurement indicating the sweet area of Example 3.

The coefficients of restitution of the heads were measured on the basis of "Procedure for Measuring the velocity Ratio of a club Head for conformance to Rule 4-1e, Revision 2 (Feb. 8th 1999) of U.S.G.A." The test was carried out by shifting the point that hits a ball by intervals of 3 mm upward, downward, leftward and rightward, respectively, from the sweet spot SS, which is the original point, on the face surface 2, as shown in FIG. 11. Then, a region having a constant of restitution of 0.830 was measured, as shown in graphs where the areas thereof are measured. The evaluation was carried out using an exponent that sets the area of the region of a high restitution in Comparative Example 1 at 100. The greater the numeral value is, the greater and more preferable is the region of a high restitution. In addition, the results of comparative Example 1 and Examples 1 to 3 are shown in the graphs of FIGS. 12 to 15.

<Hitting Test>

A hitting test was carried out where seven golfers (HDCP 15 to 25) hit ten balls each so that the average carry (carry+run) of hit balls were measured. In addition, the sound of hit balls was evaluated according to a five point method based on feel. The greater the numeral value is, the better the sound of a hit ball is.

<Durability Test>

Shot Robot III made by Miyamae corporation was utilized and made to hit 3,000 three piece golf balls in a sequential manner with the sweet spot at a head speed of 51 m/s, and thus, it was confirmed whether or not a crack, damage or the like occurred.

The test results are shown in Table 1.

As a result of the test, it can be confirmed that the region of a high restitution has been expanded in the examples. In addition, it can be confirmed that carry has been increased in the hitting test by actual golfers.

TABLE 1

Figure 16:
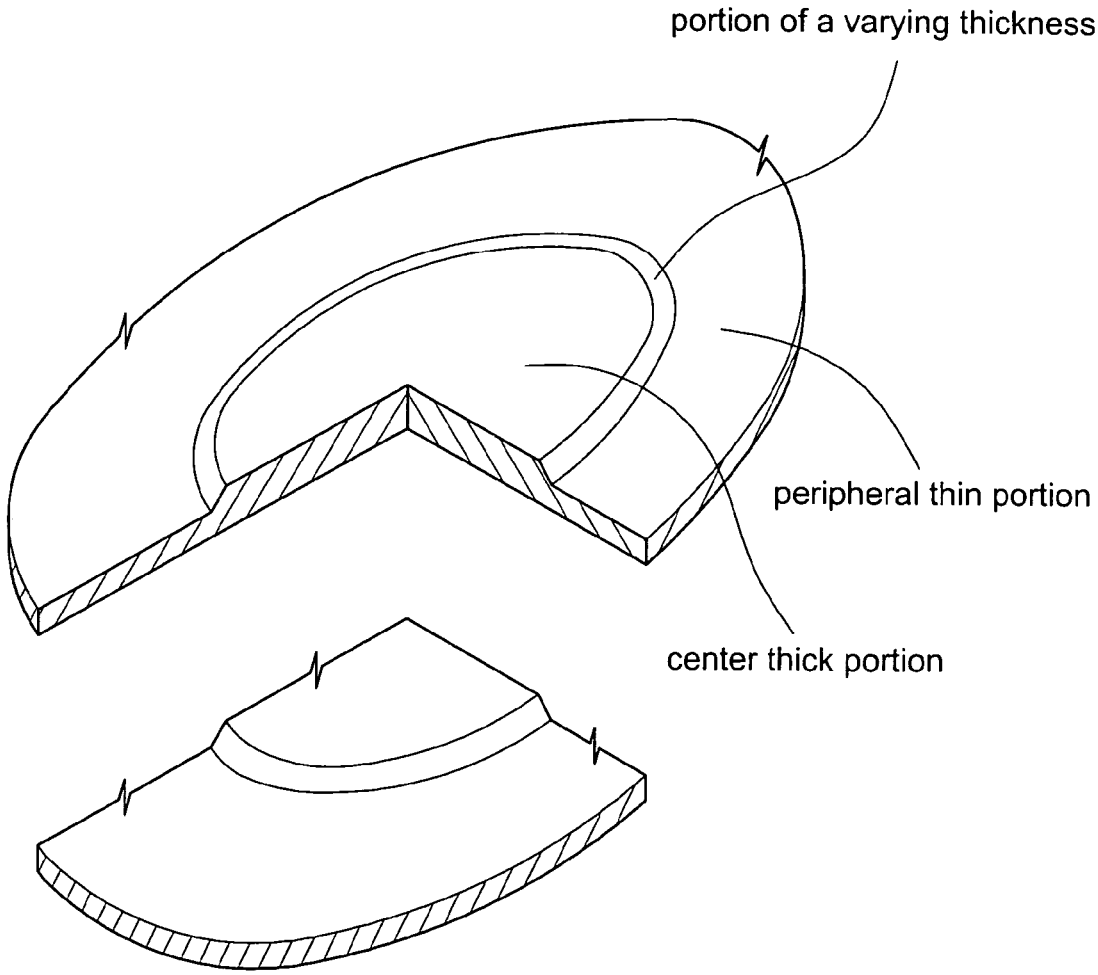
FIG. 16 is a perspective view of the face portion of comparative Example 1 viewed from the back side.

| | | Comparative Example 1 | Comparative Example 2 | Comparative Example 3 | Example 1 | Example 2 | Example 3 |
|---|---|---|---|---|---|---|---|
| Specifications of face portion | | FIG. 16 | FIG. 16 | FIG. 5 | FIG. 5 | FIG. 9 | FIG. 10 |
| Thickness t1 of center thick portion [mm] | | 2.85 | 2.85 | 2.85 | 2.85 | 2.85 | 2.85 |
| Area S1 of center thick portion projected on face [$mm^2$] | | 1200 | 1200 | 1200 | 1200 | 1200 | 1200 |
| Width W1 on toe or heel side of portion of varying thickness [mm] | | 3 | 3 | 0 | 10 | 10 | 5 |
| Width W2 on crown or sole side of portion of varying thickness [mm] | | 3 | 3 | 0 | 7 | 5 | 5 |
| Peripheral thin portion | Thickness t3 of first thin portion [mm] | 2.2 | 2.0 | — | 2.0 | 2.0 | 2.0 |
| | Area S2 of first thin portion [$mm^2$] | 2800 | 2800 | — | 1000 | 1100 | 1300 |
| | Thickness t2 of second thin portion [mm] | — | — | — | 2.2 | 2.2 | 2.2 |
| | Area S3 of second thin portion [$mm^2$] | — | — | — | 500 | 500 | 450 |
| | Existence of thin portion of varying thickness | Non-existence | Non-existence | Non-existence | Existence | Existence | Existence |
| | Width of thin portion of varying thickness [mm] | — | — | — | 5 | 5 | 5 |
| Test results | Area of region of high restitution (exponent) | 100 | 103 | 80 | 125 | 120 | 110 |
| | Carry in hitting test [yards] | 220 | 221 | 210 | 231 | 227 | 225.3 |
| | Sound of hit ball in hitting test (sensual evaluation) | 70 | 70 | 60 | 90 | 87 | 85 |
| | Durability test | OK at 3,000 shots | OK at 3,000 shots | OK at 3,000 shots | OK at 3,000 shots | OK at 3,000 shots | OK at 3,000 shots |

| | | Example 4 | Example 5 | Example 6 | Example 7 | Example 8 | Example 9 | Example 10 |
|---|---|---|---|---|---|---|---|---|
| Specifications of face portion | | FIG. 5 | FIG. 5 | FIG. 5 | FIG. 5 | FIG. 5 | FIG. 5 | FIG. 5 |
| Thickness t1 of center thick portion [mm] | | 2.70 | 2.70 | 2.70 | 2.80 | 2.80 | 2.80 | 2.80 |
| Area S1 of center thick portion projected on face [$mm^2$] | | 1200 | 1200 | 1200 | 1200 | 1200 | 1200 | 1200 |
| Width W1 on toe or heel side of portion of varying thickness [mm] | | 7 | 7 | 7 | 10 | 15 | 15 | 5 |
| Width W2 on crown or sole side of portion of varying thickness [mm] | | 5 | 5 | 5 | 5 | 7 | 10 | 10 |
| Peripheral thin | Thickness t3 of first thin portion [mm] | 2.0 | 2.0 | 2.0 | 2.0 | 2.0 | 2.0 | 2.0 |

TABLE 1-continued

| | | | | | | | | |
|---|---|---|---|---|---|---|---|---|
| portion | Area S2 of first thin portion [$mm^2$] | 950 | 950 | 1000 | 1000 | 1100 | 1150 | 1070 |
| | Thickness t2 of second thin portion [mm] | 2.2 | 2.2 | 2.2 | 2.2 | 2.2 | 2.2 | 2.2 |
| | Area S3 of second thin portion [$mm^2$] | 600 | 550 | 500 | 500 | 590 | 570 | 600 |
| | Existence of thin portion of varying thickness | Existence | Existence | Existence | Existence | Existence | Existence | Existence |
| | Width of thin portion of varying thickness [mm] | 5 | 10 | 15 | 10 | 10 | 10 | 10 |
| Test results | Area of region of high restitution (exponent) | 130 | 135 | 140 | 130 | 140 | 142 | 127 |
| | Carry in hitting test [yards] | 235 | 238.3 | 240.5 | 234.1 | 241.0 | 242.6 | 229.8 |
| | Sound of hit ball in hitting test (sensual evaluation) | 85 | 90 | 88 | 80 | 89 | 93 | 85 |
| | Durability test | Cracked at 2,800 shots | Cracked at 2,800 shots | Cracked at 3,000 shots | OK at 3,000 shots | OK at 3,000 shots | Cracked at 3,000 shots | OK at 3,000 shots |

The invention claimed is:

1. A golf club head having a face portion that hits a ball, said face portion comprising:

a center thick portion of substantially uniform thickness that forms a center region, which includes the sweet spot and has the greatest thickness;

a varying thickness portion in annular form, which is formed around said center thick portion and has a thickness that gradually decreases toward the periphery of the face portion; and a peripheral thin portion provided around said varying thickness portion and having a thickness smaller than that of said center thick portion, wherein said peripheral thin portion includes a first thin portion of which the thickness is the smallest and is substantially constant, and a second thin portion of which the thickness is greater than that of the first thin portion and is substantially constant, and said first thin portion is provided in at least one of a sole side portion, a toe side portion and a heel side portion of the peripheral thin portion.

2. The golf club head according to claim 1, wherein said peripheral thin portion is provided with a varying thickness portion between the first thin portion and the second thin portion in which the thickness gradually decreases from the second thin portion toward the first thin portion.

3. The golf club head according to claim 1, wherein the varying thickness portion has a maximum width portion having the maximum width on the toe side and/or on the heel side;

the first thin portion is provided on both the toe side and the heel side of the peripheral thin portion; and the second thin portion is provided on the crown side and on the sole side.

4. The golf club head according to claim 3, wherein the maximum width portion of the varying thickness portion has a thickness of not less than 5 mm and not greater than 15 mm.

5. The golf club head according to claim 1, wherein the varying thickness portion has a varying ratio of the thickness of 15% to 70% on the toe side and on the heel side, and a varying ratio of the thickness of 22% to 70% on the crown side and on the sole side.

6. The golf club head according to claim 1 wherein the area of the center region formed of the center thick portion is 20% to 60% of the surface area of said face portion.

7. The golf club head according to claim 1, wherein the ratio (t3/t1) is not less than 0.55, and not greater than 0.85;

the ratio (t2/t1) is not less than 0.65, and not greater than 0.90; and the ratio (t3/t2) is not less than 0.75, and not greater than 0.85 in which ti is the thickness of the center thick portion, t2 is the thickness of the second thin portion and t3 is the thickness of the first thin portion.

8. The golf club head according to claim 1, wherein said peripheral thin portion is composed of a crown side portion, a sole side portion, a toe side portion and a heel side portion, and said second thin portion is provided in at least said crown side portion.

* * * * *